US009022301B2

(12) United States Patent
Sell et al.

(10) Patent No.: US 9,022,301 B2
(45) Date of Patent: May 5, 2015

(54) AEROSOL MANIFOLD AND METHOD OF ITS FABRICATION

(75) Inventors: Steven A. Sell, Belton, MO (US); William L. Driskell, Lee's Summit, MO (US); David L. Dejong, Ogden, UT (US)

(73) Assignee: MeadWestvaco Calmar, Inc., Richmond, VA (US)

( * ) Notice: Subject to any disclaimer, the term of this patent is extended or adjusted under 35 U.S.C. 154(b) by 499 days.

(21) Appl. No.: 13/496,603

(22) PCT Filed: Sep. 30, 2010

(86) PCT No.: PCT/US2010/050866

§ 371 (c)(1), (2), (4) Date: Mar. 16, 2012

(87) PCT Pub. No.: WO2011/041514

PCT Pub. Date: Apr. 7, 2011

(65) Prior Publication Data

US 2012/0175433 A1 Jul. 12, 2012

Related U.S. Application Data

(60) Provisional application No. 61/247,075, filed on Sep. 30, 2009.

(51) Int. Cl.

| | |
|---|---|
| ***B05B 7/32*** | (2006.01) |
| ***B65D 83/28*** | (2006.01) |
| ***B65D 83/20*** | (2006.01) |
| ***B65D 83/14*** | (2006.01) |
| ***B05B 15/06*** | (2006.01) |

(52) U.S. Cl.

CPC ..... *B65D 83/28* (2013.01); *B65D 83/20* (2013.01); *B65D 83/7532* (2013.01); *B65D 83/205* (2013.01); *B05B 15/065* (2013.01); *B65D 83/201* (2013.01)

(58) Field of Classification Search

CPC .. B05B 11/3011; B05B 11/3057; B05B 1/16; B05B 15/065; B65D 83/28; B65D 83/201; B65D 83/20; B65D 83/7532; B65D 83/205

USPC ..... 239/333, 337, 390, 391, 397, 600; 222/321, 321.2, 383.1, 386, 402.13; 285/18, 332

See application file for complete search history.

(56) References Cited

U.S. PATENT DOCUMENTS

| | | | | | |
|---|---|---|---|---|---|
| 3,703,994 | A | * | 11/1972 | Nigro | 239/397 |
| 4,183,449 | A | * | 1/1980 | Blake | 222/321.2 |
| 4,953,791 | A | * | 9/1990 | Tada | 239/333 |
| 5,332,157 | A | * | 7/1994 | Proctor | 239/333 |
| 5,467,900 | A | * | 11/1995 | Maas et al. | 222/383.1 |
| 6,186,371 | B1 | | 2/2001 | De Pous et al. | |
| 2007/0164056 | A1 | | 7/2007 | Eberhardt et al. | |

FOREIGN PATENT DOCUMENTS

| | | | |
|---|---|---|---|
| DE | 19726583 | A1 | 12/1998 |
| DE | 20006135 | U1 | 6/2000 |

OTHER PUBLICATIONS

International Search Report for PCT/US2010/050866 dated Mar. 8, 2011.

* cited by examiner

*Primary Examiner* — Steven J Ganey

(74) *Attorney, Agent, or Firm* — MeadWestvaco Intellectual Property Group

(57) ABSTRACT

An improved manifold for an aerosol system may include a valve interface (120) capable of flexing to fit with a valve stem of an aerosol system and form a seal and methods for making a manifold may include a gate (106) positioned to improve contact between steel defining a fluid flow path in the manifold.

14 Claims, 11 Drawing Sheets

AEROSOL MANIFOLD AND METHOD OF ITS FABRICATION

CROSS-REFERENCE TO RELATED APPLICATIONS

This application is a National Phase application of PCT Application PCT/US10/50866, entitled "AEROSOL MANIFOLD AND METHOD OF ITS FABRICATION," filed 30 Sep. 2010, which claims the benefit of U.S. Provisional Application No. 61/247,075, entitled "AEROSOL MANIFOLD AND METHODS OF USING THE SAME," filed Sep. 30, 2009, each of which are incorporated herein by reference in their entireties.

BACKGROUND OF THE INVENTION

1. Field of the Invention

The invention relates to manifolds and manifold configurations for aerosol systems and more particularly to manifold geometries and interfaces and to methods for making manifolds for aerosol systems.

2. State of the Art

Aerosol delivery systems are well known and have traditionally included an actuating button used to both actuate a valve of an aerosol system and to deliver the product released from the valve in a desired direction. For example, push-button type actuating buttons may include a fluid flow path through the button with a valve interface on one end and an orifice or opening at an opposite end of the fluid flow path. The push-button may be press-fit or slip-fit over a valve stem of an aerosol system such that the valve interface mates with the valve stem through the press-fit or slip-fit configuration.

More recently, trigger actuated aerosol systems are being employed to deliver a desired product from an aerosol system. For example, trigger actuated aerosol systems such as those disclosed in U.S. Patent Application Publication 2007/0062980 have been commercialized. In the trigger actuated aerosol systems a manifold is typically used to transport a product released from a valve or valve stem of an aerosol system to an orifice integrated with the manifold. A manifold typically includes a valve interface, a first fluid flow path, a second fluid flow path in communication with the first fluid flow path, and a nozzle or exit on an end opposite the valve interface. The valve interface is typically slip-fit or press-fit over a valve stem of an aerosol system such that when the manifold is actuated or pressed down, the valve interface actuates the valve stem, releasing product from the valve which then flows through the first fluid flow path and second fluid flow path where it is released through the nozzle or exit of the manifold.

While manifolds have been used with trigger actuated aerosol systems, problems exist with the conventional manifold systems. For example, a manifold (or conduit) such as that described in U.S. Patent Application Publication 2007/0062980 must be press-fit to a valve stem of an aerosol system. The press-fit must either take place during the assembly of the aerosol trigger sprayer to the aerosol system or upon the first actuation of the aerosol system by a user. In those instances where the press-fit is accomplished during assembly of a trigger sprayer to an aerosol system, the press-fit of the manifold valve interface to the valve stem of the aerosol system invariably actuates the valve stem, thereby releasing a portion of the product into the manifold. The assembly of the trigger sprayer and aerosol device therefore requires or results in an actuation of the product which is undesirable.

In other instances, the assembly of the trigger sprayer and manifold to the aerosol system may leave the manifold valve interface in a position just above the valve stem of the aerosol system such that upon the first actuation of the trigger sprayer the manifold valve interface will slide over the valve stem and engage the valve stem to form a press-fit type seal with the valve stem. However, the forces required to initiate a sufficient press-fit of the manifold valve interface upon actuation are typically very high and most users do not apply sufficient force to ensure that the manifold and valve stem are sufficiently sealed. As a result, the manifold valve interface may slip off of the valve stem and residual product in the manifold may flow out of the valve interface resulting in a leak within the trigger sprayer system which is undesirable.

Therefore, improved manifold interfaces with valve stems are desirable.

BRIEF SUMMARY OF THE INVENTION

According to various embodiments of the invention, a manifold for an aerosol delivery system may include a nozzle, a valve interface, and a fluid flow path in communication with the nozzle and the valve interface, wherein the valve interface includes an outward tapered portion and an inward tapered portion. In some embodiments, the valve interface may include an outward tapered portion upstream of the inward tapered portion. Some embodiments may also include an outward tapered skirt extending from the inward tapered portion and the outward tapered skirt may assist in the assembly of the valve interface with an aerosol valve.

According to some embodiments of the invention, a manifold according to embodiments of the invention may be molded from a plastic, resin, composite, or other material. During molding, the vertical flow path may be created by a first piece of steel and the horizontal flow path formed by a second piece of steel. A mold gate may be positioned inline with the horizontal flow path but on the opposite side of the vertical flow path. Such positioning of the mold gate may improve the molding process and reduce stress on the gating juncture of the flow paths.

A manifold according to embodiments of the invention may be fitted with or fitted to a valve attached to an aerosol can or container. In addition, a trigger or actuator may be configured to work with, move, or actuate the manifold such that the manifold may be used to actuate a valve and deliver fluid through the manifold.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Embodiments of the invention relate to manifolds and more particularly to manifolds for use with trigger actuated aerosol systems. Other embodiments of the invention relate to connections between a manifold or other fluid flow path and a valve or valve stem of an aerosol system. In still other embodiments of the invention, manifolds may include a unique gating feature and methods for making manifolds to be used with trigger actuated aerosol systems may utilize the gating feature to reduce costs associated with the molding of the manifolds or for assembly of the manifolds with trigger actuated aerosol systems.

Figure 19:
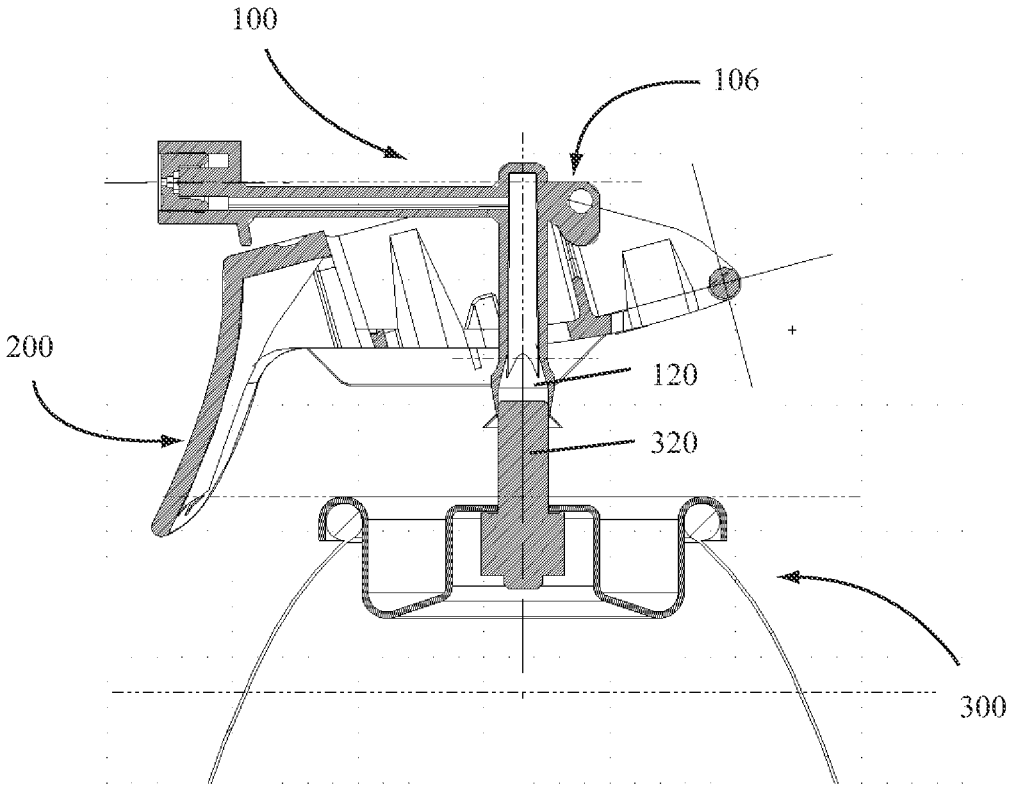
FIG. 19 illustrates a cross-sectional view of a manifold valve according to various embodiments of the invention connected to a trigger, a valve and an aerosol container.

A manifold 100 according to various embodiments of the invention may include a valve interface 120, a fluid flow path 102 in communication with the valve interface 120 and a nozzle 110 in communication with the fluid flow path as illustrated in FIGS. 1 through 15. According to embodiments of the invention, the manifold 100 may be assembled with a trigger sprayer actuation system and connected to an aerosol system for delivery of a product from the aerosol system. For example, a manifold 100 according to various embodiments of the invention may be integrated with a trigger 200 and aerosol system 300 as illustrated in FIG. 19. In some embodiments of the invention, the manifold 100 may include a gate 106 utilized during the molding of a manifold 100 and the gate 106 may be positioned to improve the cycle time or efficiency of a molding process or an assembly process.

Figure 16:
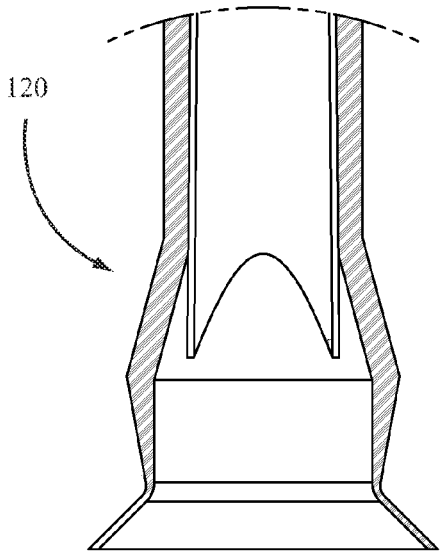
FIG. 16 illustrates a cross-sectional close-up view of a manifold valve connection according to various embodiments of the invention.

FIGS. 1 through 7 illustrate a particular manifold 100 according to various embodiments of the invention, including various views of the manifold 100. The valve interface 120 of the manifold 100 illustrated in FIGS. 1 through 7 is further illustrated in FIGS. 8A and 8B in communication with a valve stem 320. Similarly, FIGS. 9 through 15 illustrate a manifold 100 according to other embodiments of the invention. FIG. 16 illustrates the valve interface 120 of the manifold 100 illustrated in FIGS. 9 through 15 in communication with a valve stem 320 of an aerosol system 300.

According to certain embodiments of the invention, the valve interface 120 of a manifold 100 may include an outward tapered portion 122 tapering from a connection with the manifold wall defining the fluid flow path 102 out to a thick portion 124 and an inward tapered portion 126 tapering from the thick portion 124 inward to a thin portion 128. An outward tapered skirt 130 may flair out from the thin portion 128 and may create an opening at the end of the outward tapered skirt 130 which is larger than an opening in the valve interface 120 defined by the circumference of the thin portion 128 of the manifold 100. A valve stem 320 may be received by the valve interface 120 such that the valve stem 320 fits within the opening defined by the circumference of the thin portion 128 of the manifold 100.

According to certain embodiments of the invention, the outward tapered portion 122 may include a constant thickness, a decreasing thickness, an increasing thickness, or a variable thickness that changes multiple times as desired. Similarly, the inward tapered portion 126 may include a constant thickness, a decreasing thickness, an increasing thickness, or a variable thickness that changes multiple times as desired. In some embodiments of the invention, the outward tapered portion 122 may include a thickness that decreases and then increases to the thickness of the thick portion 124 and an inward tapered portion 126 thickness that decreases between the thick portion 124 and the thin portion 128. For example, in some embodiments of the invention, the thick portion 124 may have a thickness or width of about 0.020 inches and the thin portion 128 may have thickness or width of about 0.005 inches.

Figure 8A:
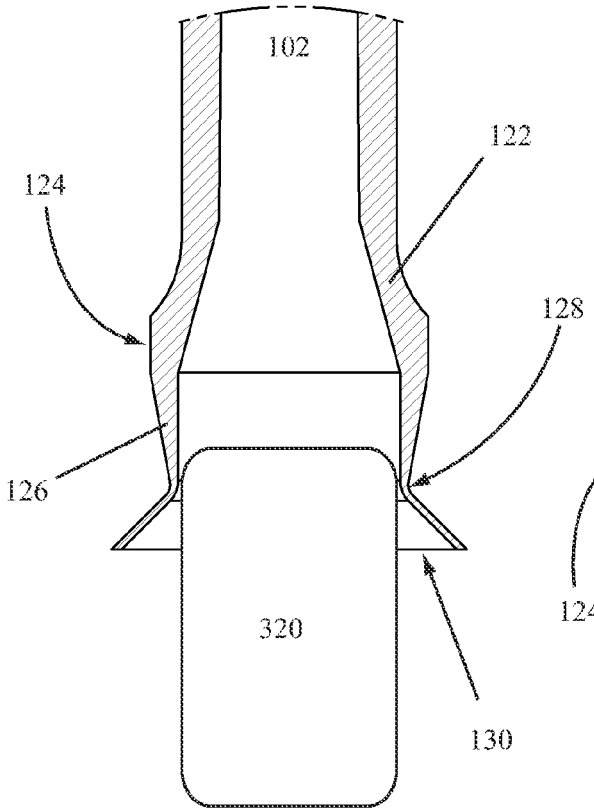
FIG. 8A illustrates a cross-sectional close-up view of a manifold valve connection according to various embodiments of the invention.
Figure 8B:
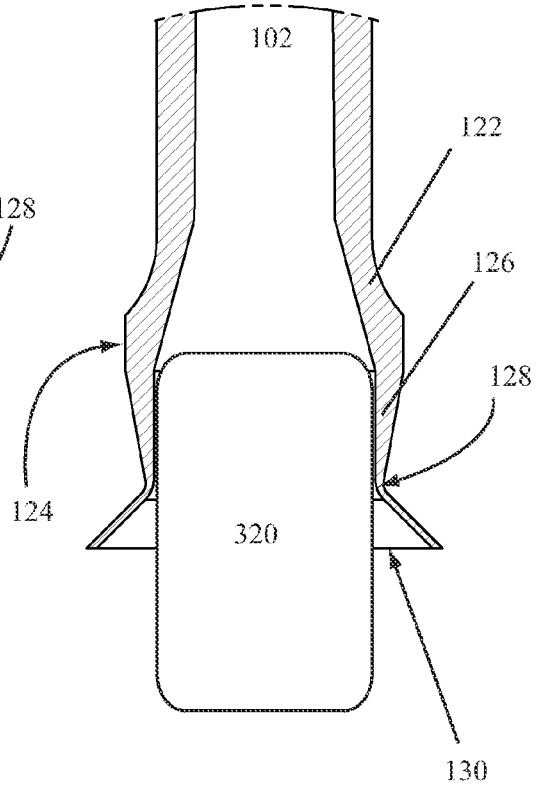
FIG. 8B illustrates a cross-sectional close-up view of a manifold valve connection according to various embodiments of the invention.
Figure 9:
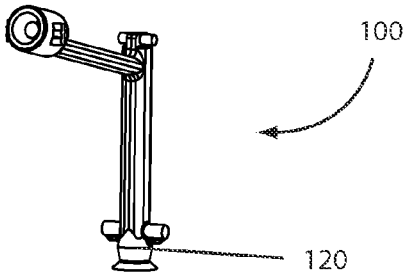
FIG. 9 illustrates a manifold according to various embodiments of the invention.
Figure 10:
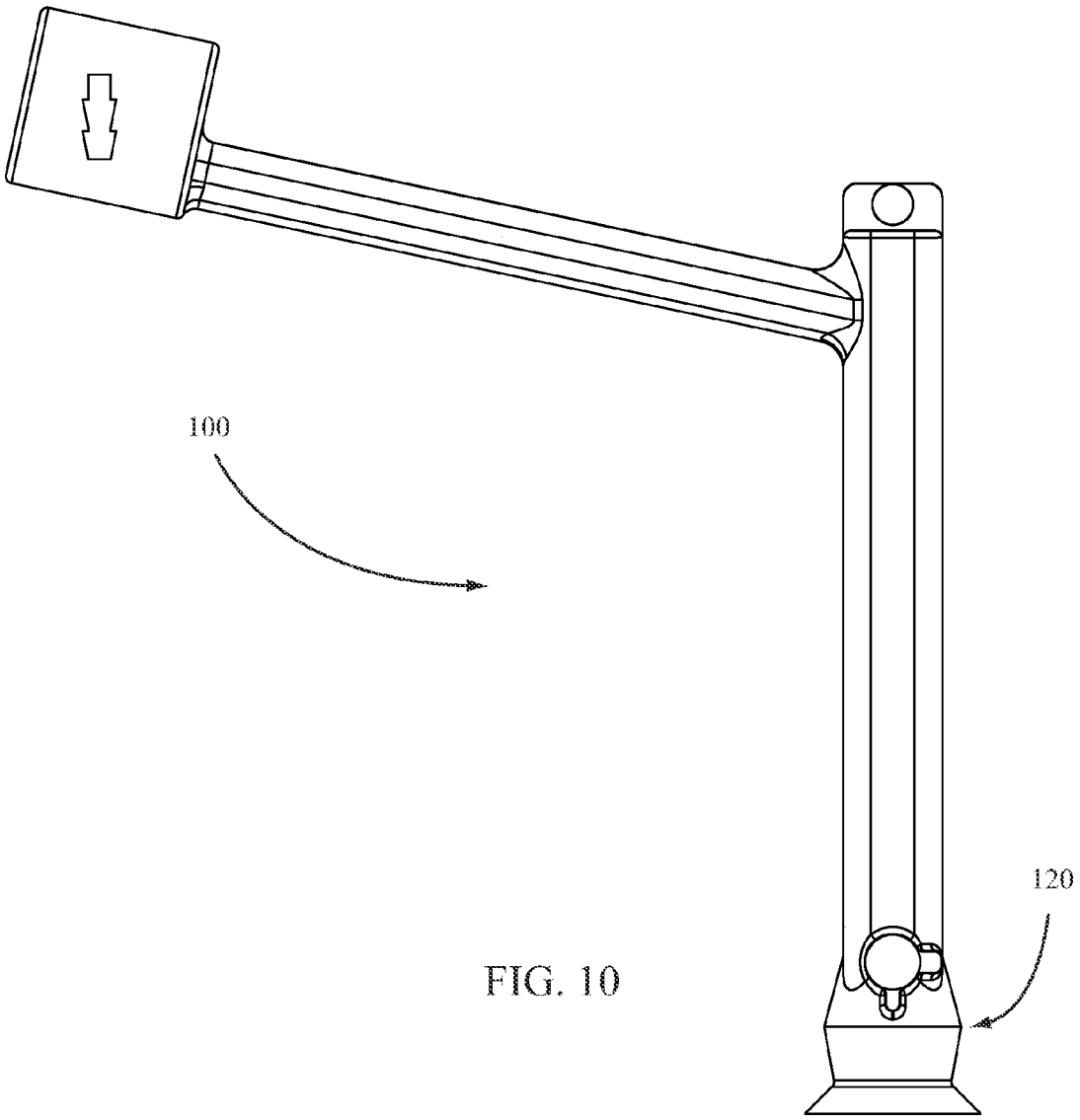
FIG. 10 illustrates a side view of a manifold according to various embodiments of the invention.
Figure 11:
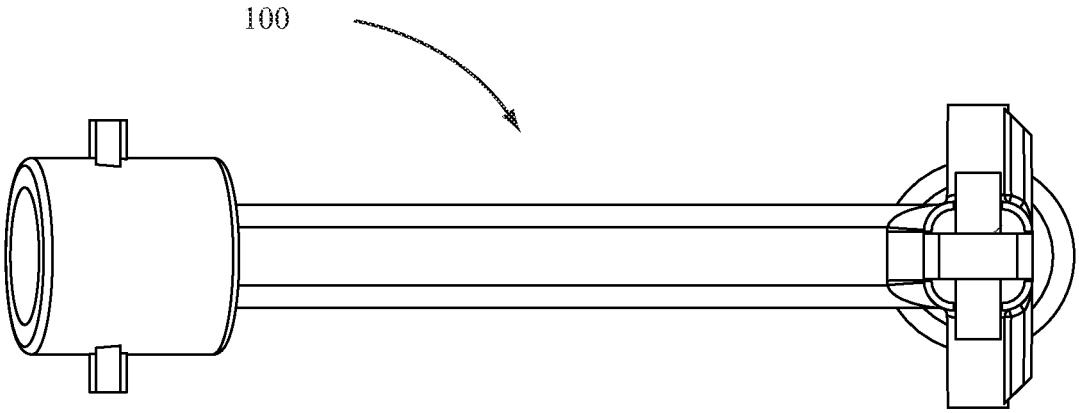
FIG. 11 illustrates a top view of a manifold according to various embodiments of the invention.

According to embodiments of the invention, a valve interface 120 may include a bell or bowed shape having an outward tapered portion 122 and an inward tapered portion 126 as illustrated in FIGS. 8A and 8B. The widest portion, or thick portion 124, of the valve interface 120 may occur at the joint or juncture of the outward tapered portion 122 and the inward tapered portion 126.

Various valve interfaces 120 according to embodiments of the invention may provide an improved seal with a valve stem 320 of an aerosol system 300. For example, the valve interface 120 illustrated in FIGS. 8A and 8B seals with the valve stem 320 thereby preventing leakage which may occur with conventional valve interface components. Unlike a conventional press-fit system or a slip-fit system where a valve interface of a manifold requires a high force to slide over a valve stem during use, the valve interface 120 according to various embodiments of the invention may expand to seal around a valve stem 320. As a valve stem 320 meets with the valve interface 120, the configuration of the inward tapered portion 126 allows the valve interface 120 to flex, slightly expanding to accept a valve stem 320 in the opening formed by the circumference of the thin portion 128. The expansion of the valve interface 120 may apply a force back on the valve stem 320, thereby forming a seal with the valve stem 320 when the manifold 100 is assembled to an aerosol system 300. The seal formed between the valve interface 120 and the valve stem 320 may prevent leakage of product from the manifold 100 after the aerosol system has been actuated.

According to various embodiments of the invention, the outward tapered skirt 130 may provide a guide for a valve stem 320 during assembly of an aerosol system. As a manifold 100 and other components of an aerosol trigger sprayer are assembled with an aerosol system 300, the outward tapered skirt 130 allows the valve interface 120 to be assembled with some variances. For example, as the valve interface 120 is lowered over an aerosol system 300 having a valve stem 320, the valve stem 320 may interact with a portion of the outward tapered skirt 130 which interaction may guide the valve interface 120 into a proper position with the valve stem 320. Thus, the positioning of the valve stem 320 with respect to the valve interface 120 may be off by a small percentage during assembly or actuation while still assuring that the valve interface 120 and valve stem 320 will properly mate.

In some embodiments of the invention, the valve interfaced 120 may also slide along a valve stem 320 during actuation of an aerosol system 300. As illustrated in FIG. 8B, a valve interface 120 may slide down a valve stem 320 during an actuated state. A seal between the valve interface 120 and the valve stem 320 may be maintained during such actuation. Further, when actuation of the manifold 100 and the aerosol system 300 is released or ceased, the valve interface 120 may slide back to the position illustrated in FIG. 8A. Regardless, a seal between the valve interface 120 and the valve stem 320 may remain intact. The seal between the valve interface 120 and the valve stem 320 may help prevent leakage between the manifold 100 and the aerosol system 300.

According to various embodiments of the invention, a valve interface 120 having an outward tapered portion 122 from a wall of a manifold 100 fluid flow path 102, joined with an inward tapered portion 126 to form an opening to the manifold 100 fluid flow path 102 may improve a seal or interface of the valve interface 120 with a valve stem 320 of an aerosol system 300. According to embodiments of the invention, when a valve interface 120 is mated to a valve stem 320, the valve interface 120 may flex to allow the valve stem 320 to fit into an opening in the inward tapered portion 126. The interface of the inward tapered portion 126 with the valve stem 320 may form a seal between the valve interface 120 and the valve stem 320 whereby product left in the manifold 100 fluid flow path 102 after actuation of an aerosol trigger sprayer is contained within the manifold 100 fluid flow path 102 and does not leak from the valve interface 120. In some embodiments, the thickness of the outward tapered portion 122 and inward tapered portion 126 may be selected to provide a desired force requirement to flex the valve interface 120 and allow fitment to a valve stem 320 or to provide a desired sealing force once a valve stem 320 is mated with, or fitted into, the valve interface 120.

Figure 17:
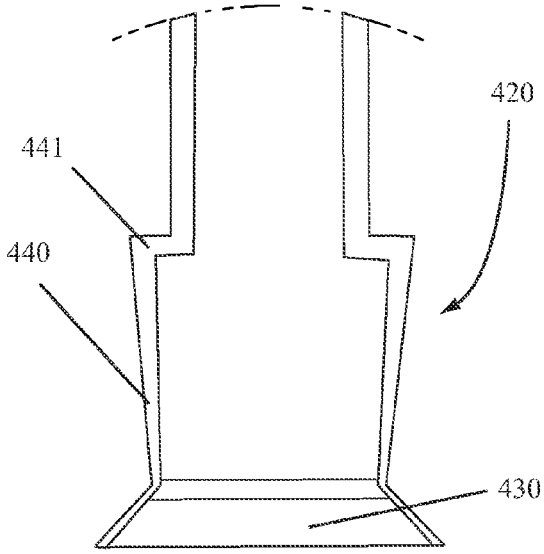
FIG. 17 illustrates a cross-sectional close-up view of a manifold valve connection according to various embodiments of the invention.

While various embodiments of a valve interface are illustrated in FIGS. 1 through 16, other valve interface 420 configurations may also be used to improve the seal or contact between a manifold 100 and a valve stem 320. For instance, an alternate valve interface 420 for a manifold 100 according to some embodiments of the invention is illustrated in FIG. 17. As illustrated, the valve interface 420 may include a shoulder 441 extending outward from a wall of the manifold 100 and a tapered portion 440 tapering from the end of the shoulder 441 to an opening defined by a thin portion where the tapered portion 440 meets an outward tapered skirt 430. When a valve stem 320 is positioned in the valve interface 420 illustrated in FIG. 17, the tapered portion 440 may flex to allow the valve stem 320 into an opening in the valve interface 420. The valve interface 420 may form a seal with the valve stem 320 and the tapered nature of the tapered portion 440 may apply sufficient force between the valve stem 320 and the valve interface 420 such that fluid in the manifold 100 will not leak out of the valve interface 420 after actuation of an aerosol system 300.

Figure 18:
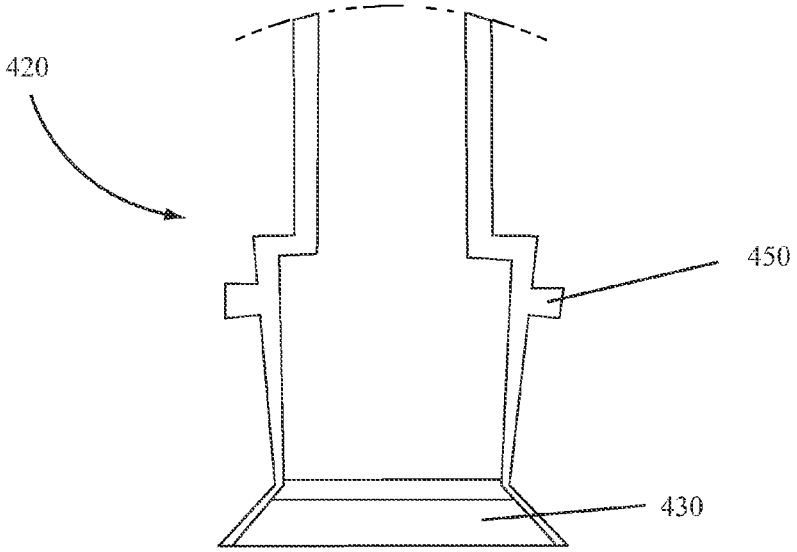
FIG. 18 illustrates a cross-sectional close-up view of a manifold valve connection according to various embodiments of the invention.

Another embodiment of a manifold 100 with a valve stem 420 according to embodiments of the invention is illustrated in FIG. 18. A valve stem 420 may include additional projections 450 to provide further strength to the tapered portion 440 of a valve interface 420. The projections 450 may be configured to alter the force with which the tapered portion 440 presses against a valve stem 320 inserted in the valve interface 420. The configured force may be adjusted to help retain a seal to prevent leakage between the valve stem 320 and the valve interface 420.

According to embodiments of the invention, a manifold may be slip-fitted or press-fit to a valve stem 320 of an aerosol system 300 such that the manifold 100 forms a seal with the valve stem 320, thereby reducing or eliminating leakage between the manifold 100 and valve stem 320.

Figure 1:
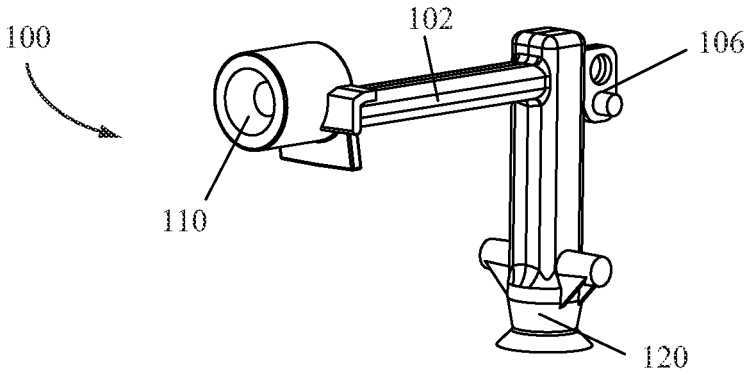
FIG. 1 illustrates a manifold according to various embodiments of the invention.
Figure 2:
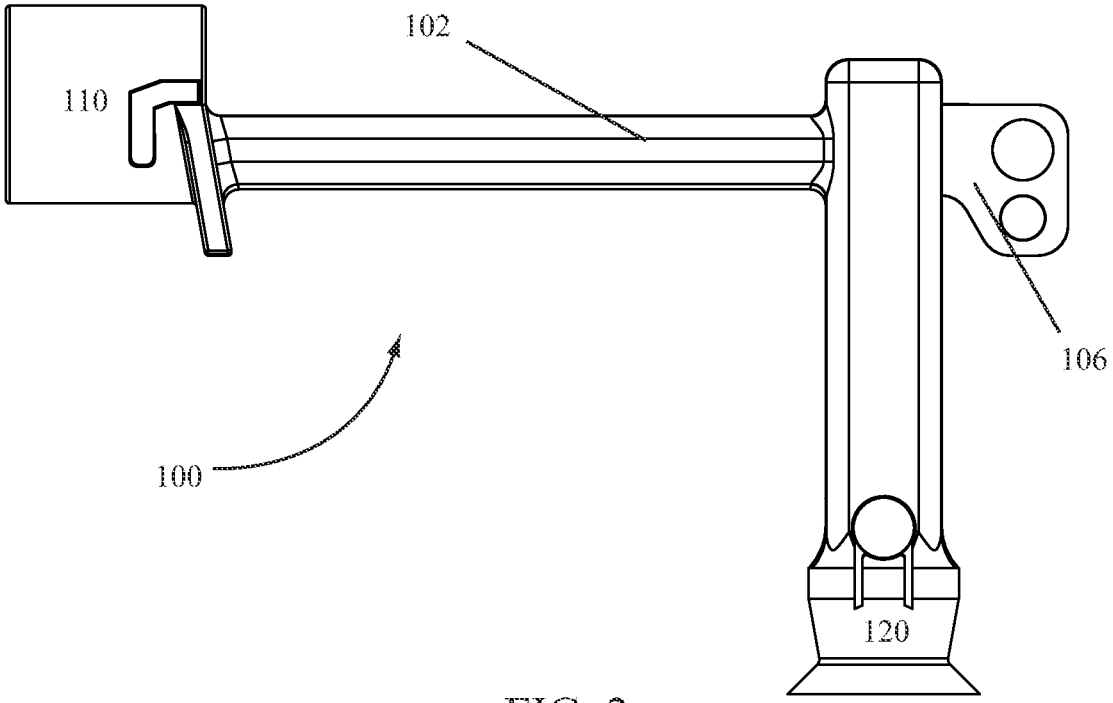
FIG. 2 illustrates a side view of a manifold according to various embodiments of the invention.
Figure 3:
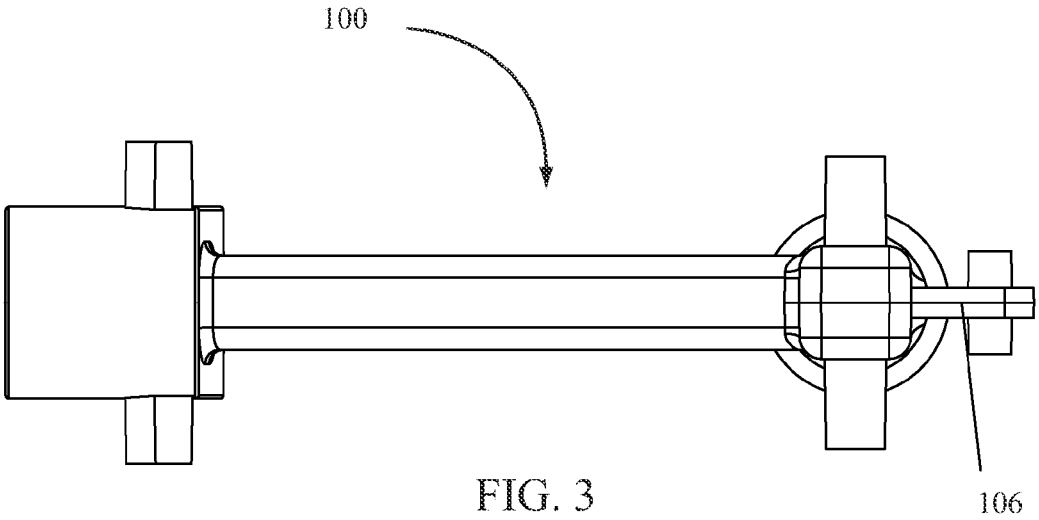
FIG. 3 illustrates a top view of a manifold according to various embodiments of the invention.
Figure 4:
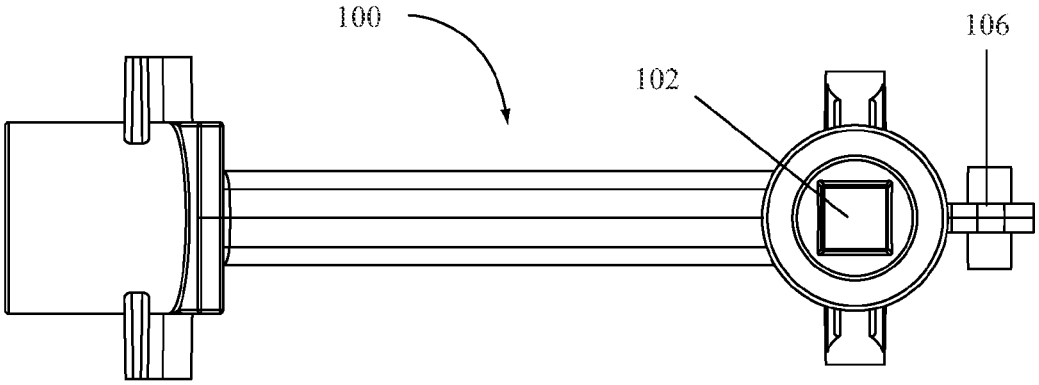
FIG. 4 illustrates a bottom view of a manifold according to various embodiments of the invention.
Figure 5:
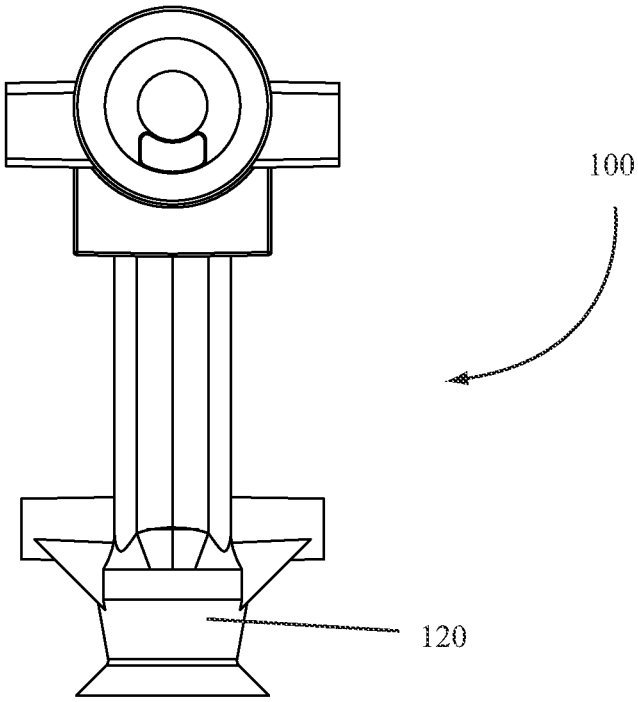
FIG. 5 illustrates a front view of a manifold according to various embodiments of the invention.
Figure 6:
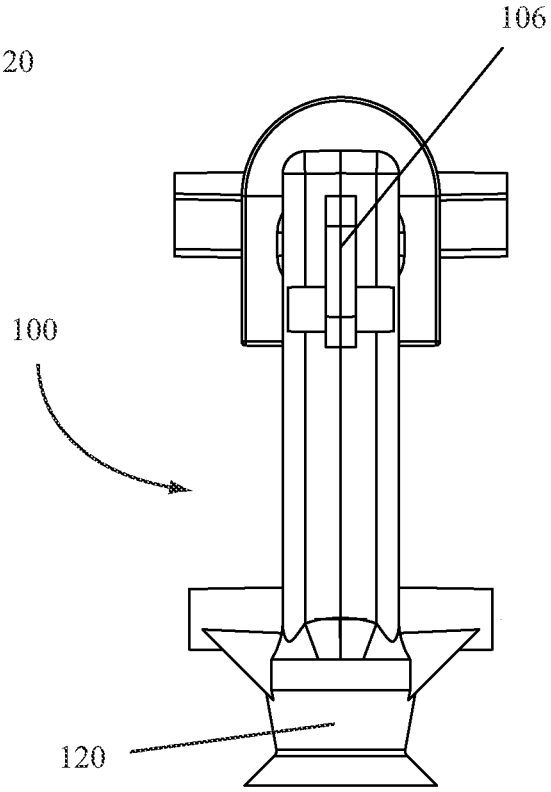
FIG. 6 illustrates a rear view of a manifold according to various embodiments of the invention.
Figure 7:
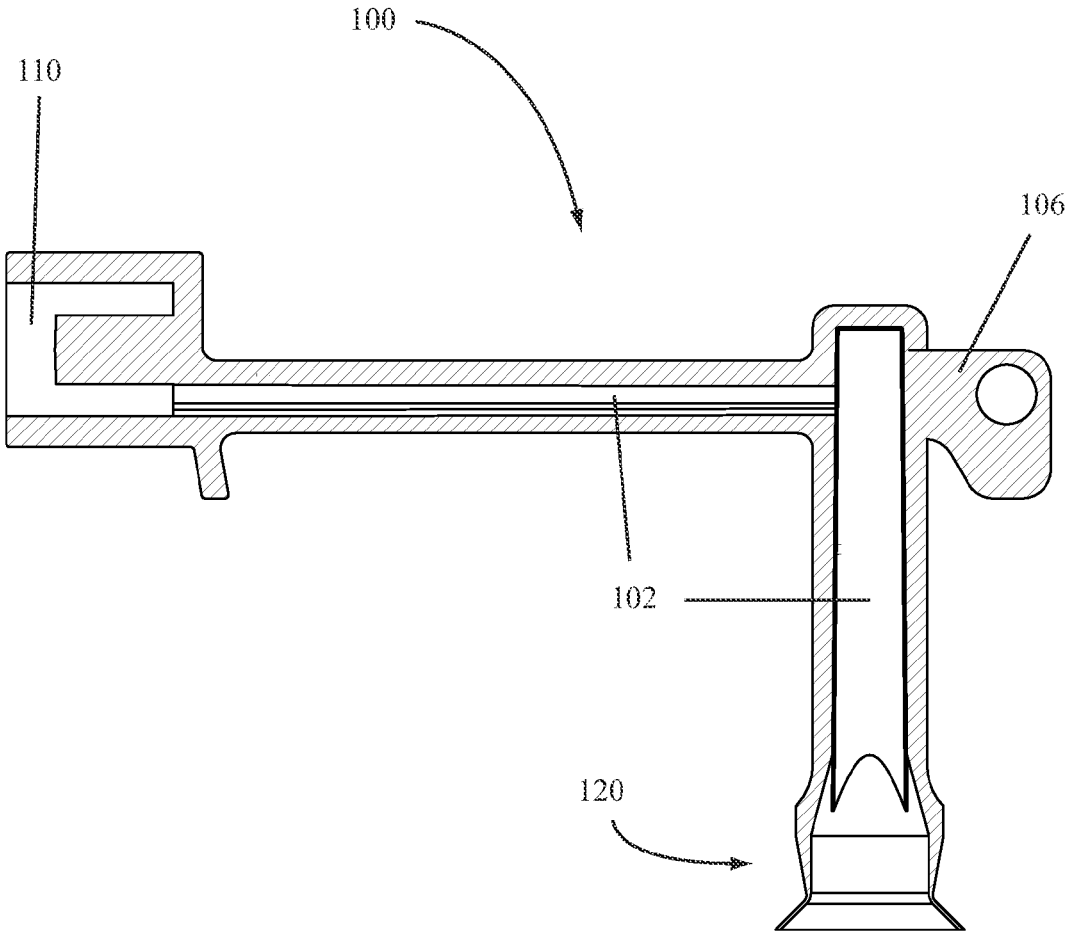
FIG. 7 illustrates a cross-sectional view of a manifold according to various embodiments of the invention.
Figure 12:
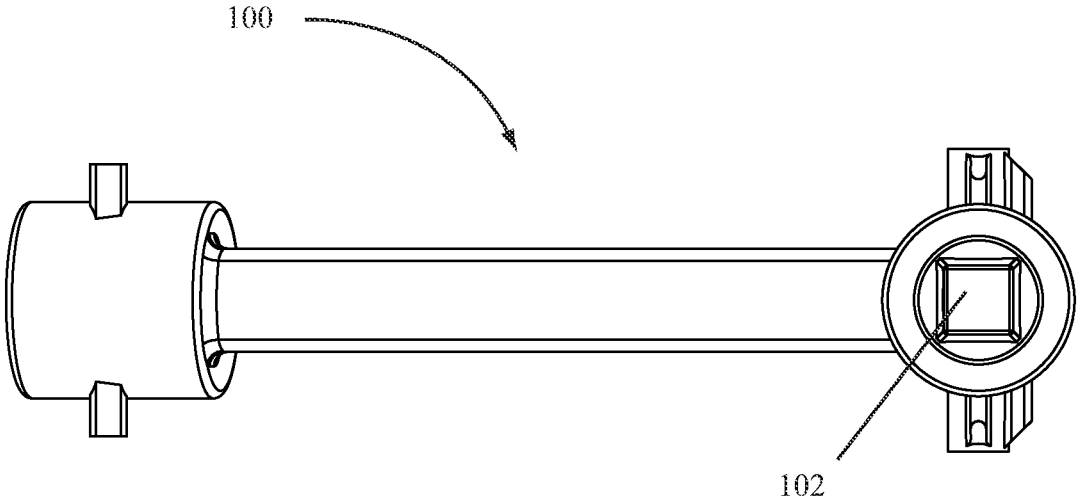
FIG. 12 illustrates a bottom view of a manifold according to various embodiments of the invention.
Figures 13, 14:
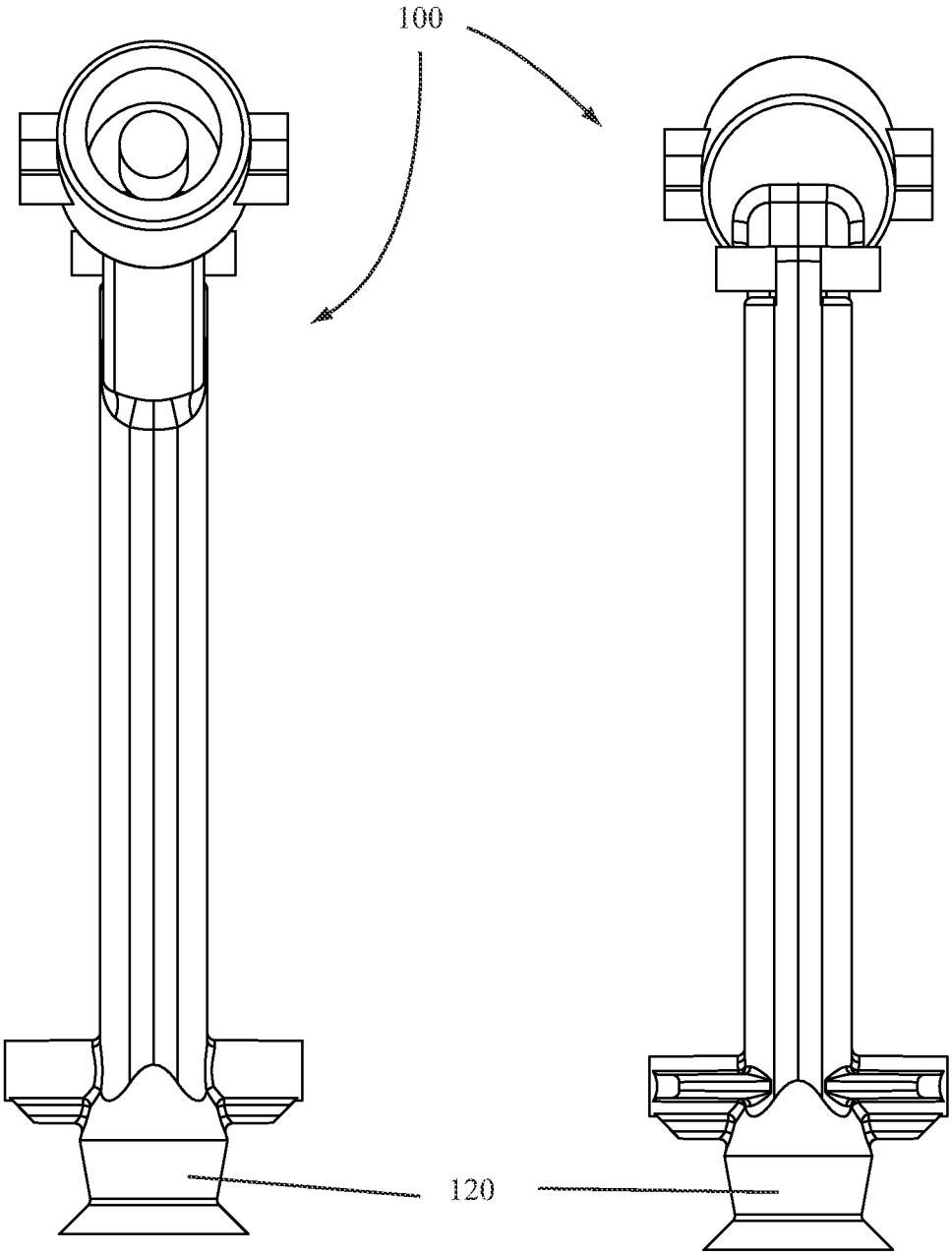
FIG. 13 illustrates a front view of a manifold according to various embodiments of the invention.
FIG. 14 illustrates a rear view of a manifold according to various embodiments of the invention.
Figure 15:
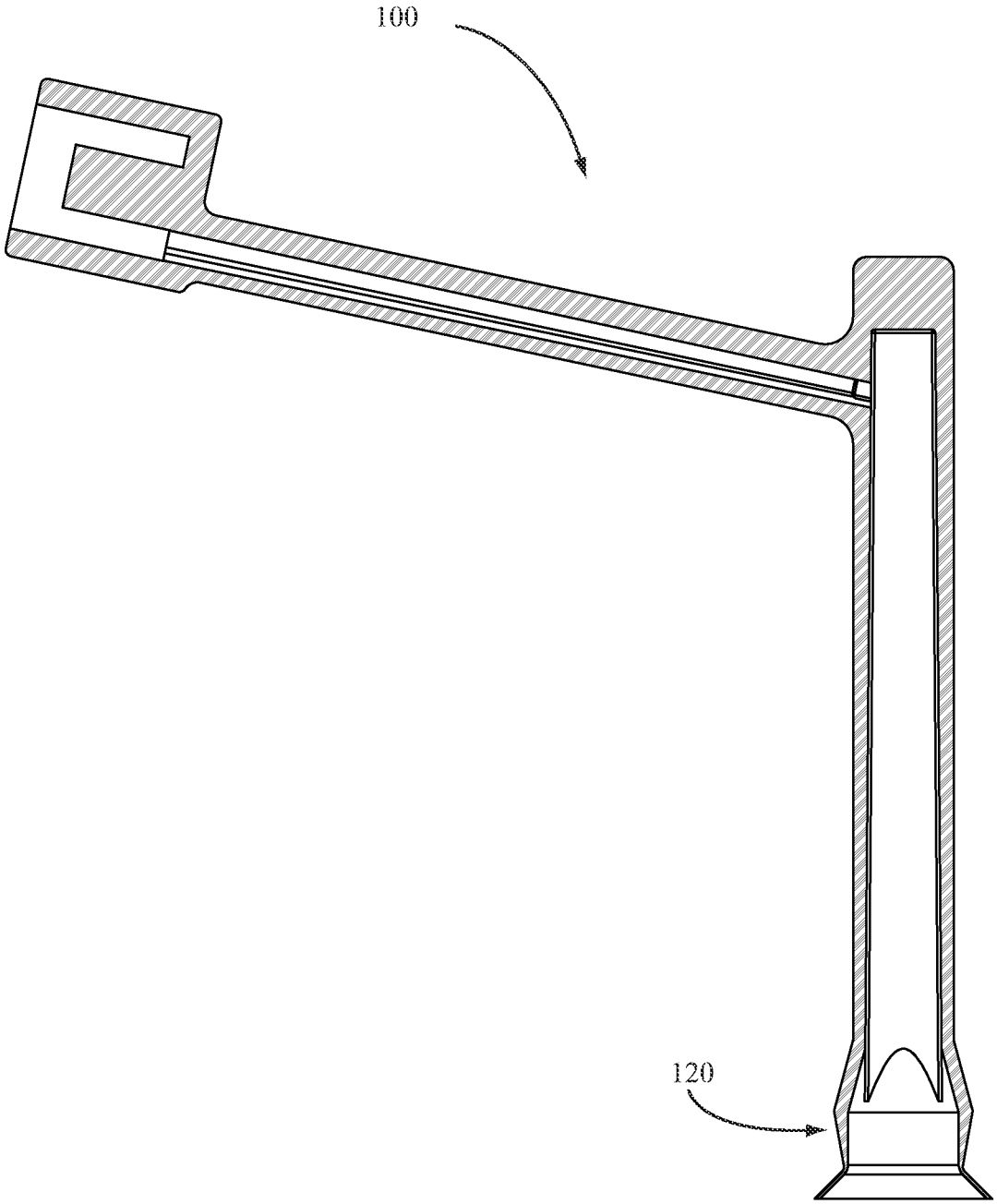
FIG. 15 illustrates a cross-sectional view of a manifold according to various embodiments of the invention.

According to some embodiments of the invention, a flow path 102 may include a square or rectangular cross-section as illustrated in FIGS. 4 and 12. As shown in FIGS. 4 and 12, the flow path 102 through the manifold 100 may be substantially square or rectangular. In certain embodiments of the invention, the square or rectangular shape allows the manifold 100 to be molded with tools having square or rectangular shaped details. The use of such details during the molding of the manifold 100 may improve the efficiency of a mold. For example, it may be easier, and cheaper, to form a mold tool having square details rather than rounded details. In addition, the meeting of square tool details may be easier to accomplish than joining rounded or circular openings. This, the square or rectangular shaped cross-section may provide advantages during molding.

According to other embodiments of the invention, a manifold 100 may include a gate 106 positioned at a rear part of the manifold as illustrated in FIGS. 1 through 7 and 19. The positioning of the gate 106 in the location illustrated in FIGS. 1 through 7 and 19 may provide improved molding efficiency and a reduction in defects in the molded manifolds 100. For example, as illustrated in the cross-sectional diagram of FIG. 7, the fluid flow path 102 includes a vertical flow path flowing from the valve interface 120 towards the gate 106 and a horizontal flow path flowing from the gate 106 to the nozzle 110. During molding, portions of the mold tooling extend to create the fluid flow path 102. The vertical flow path of the fluid flow path 102 may be created by one piece of steel and the horizontal flow path may be created by another piece of steel and the two pieces of steel may meet at the juncture of the vertical and horizontal flow paths. For instance, the steel forming the horizontal flow path may touch or come in contact with the steel forming the vertical flow path. Positioning of the gate 106 in line with the horizontal flow path but on the opposite side of the vertical flow path allows the molten resin or plastic flowing into a mold to exert forces on the vertically positioned piece of steel which may help to keep that piece of steel in contact with the horizontally positioned piece of steel during the molding process. This differs from conventional processes where a gate positioned at the juncture of the two pieces of steel introduces molten resin or plastic at the juncture which can result in forces acting to push the two pieces of steel apart. When this occurs in conventional molding processes, the flow path may be compromised or sealed due to a separation of the two pieces of steel. In addition, the positioning of the gate 106 according to embodiments of the invention may help reduce or prevent flashing in the molding process, resulting in fewer defects in the manifolds 100.

According to various embodiments of the invention, a manifold 100 may be molded in a single shot as a single part. In some embodiments, a manifold 100 may be molded from resin or from a plastic material. For instance, a manifold 100 may be molded from polypropylene or other plastic material. In other embodiments, other materials, such as silicon, carbon fiber, or other materials may also be used.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A manifold, comprising:

a nozzle at a first end of the manifold;

a valve interface at a second end of the manifold opposite the nozzle;

a manifold wall connected to and extending from the nozzle to the valve interface and defining a fluid flow path in communication with the nozzle and valve interface; and a wherein the valve interface comprises:

an outward tapered portion extending from a portion of the manifold wall opposite the nozzle; and an inward tapered portion extending from the outward tapered portion to form an opening in the valve interface.

2. The manifold of claim 1, wherein the fluid flow path comprises a vertical flow path portion and a substantially horizontal flow path portion.

3. A valve interface of an aerosol manifold, comprising:

an outward tapered portion extending from a manifold wall; and an inward tapered portion extending from the outward tapered portion to form an opening for the aerosol manifold.

4. The valve interface of claim 3, further comprising a thick portion at the interface of the outward tapered portion and the inward tapered portion.

5. The valve interface of claim 3, wherein the outward tapered portion is thicker than the inward tapered portion.

6. The valve interface of claim 3, further comprising a thin portion at a termination of the inward tapered portion.

7. The valve interface of claim 3, further comprising an outward tapered skirt extending from the inward tapered portion.

8. The valve interface of claim 3, wherein the outward tapered portion and inward tapered portion are formed from a molded resin material.

9. The valve interface of claim 3, wherein a portion of the inward tapered portion is configured to seal against a valve stem.

10. The valve interface of claim 6, wherein the thin portion is configured to seal a valve stem.

11. The valve interface of claim 7, wherein the outward tapered skirt comprises an opening at an end of the outward tapered skirt larger than the opening formed by the inward tapered portion.

12. The manifold of claim 1, further comprising an outward tapered skirt flaring outwards from the inward tapered portion.

13. The manifold of claim 1, further comprising a thick portion at an interface of the outward tapered portion and the inward tapered portion, wherein the thick portion is about 0.020 inches thick.

14. The manifold of claim 1, further comprising a circumferential thin portion at the opening, wherein the inward tapered portion extends from the outward tapered portion to the thin portion.

* * * * *